United States Patent [19]

Loty

[11] 4,100,406

[45] Jul. 11, 1978

[54] PHOTOELECTRIC SHUTTER TUBE WITH MICRODUCT WAFER INCORPORATED IN A WAVE PROPAGATION LINE WHICH IS INTEGRATED IN SAID SHUTTER TUBE

[75] Inventor: Charles Loty, Lesigny, France

[73] Assignee: Commissariat a l'Energie Atomique, Paris, France

[21] Appl. No.: 776,277

[22] Filed: Mar. 10, 1977

[30] Foreign Application Priority Data

Mar. 16, 1976 [FR] France ..... 76 07489

[51] Int. Cl.[2] ..... H01J 31/50

[52] U.S. Cl. ..... 250/213 VT; 250/207; 313/103 CM

[58] Field of Search ..... 250/207, 213 R, 213 VT; 313/103 R, 103 CM, 105 R, 105 CM

[56] References Cited

U.S. PATENT DOCUMENTS

| | | | |
|---|---|---|---|
| 3,864,595 | 2/1975 | Lawrence et al. | 313/103 CM |
| 3,917,402 | 11/1975 | Ohta | 250/213 VT |
| 3,992,621 | 11/1976 | Eberhardt | 250/207 |

*Primary Examiner*—David C. Nelms

*Attorney, Agent, or Firm*—Thomas R. Boland

[57] ABSTRACT

A metal layer deposited on a wafer opposite to the photocathode is brought to a potential which is at least equal to that of the photocathode. The wafer layer and screen layer form conductors for a biplanar wave-propagation line element having a characteristic impedance equal to that of an external propagation line. The shutter tube is provided with matched means for connecting the line element to the external line, a voltage signal being applied to the line element so that the screen layer is brought progressively to a higher potential than that of the wafer layer.

7 Claims, 4 Drawing Figures

PHOTOELECTRIC SHUTTER TUBE WITH MICRODUCT WAFER INCORPORATED IN A WAVE PROPAGATION LINE WHICH IS INTEGRATED IN SAID SHUTTER TUBE

This invention relates to a photoelectric shutter tube comprising a secondary-emission microduct wafer incorporated in a wave-propagation line which is integrated in said tube.

For the study of physical phenomena, it is often necessary to make use of a photoelectric detector or of a brightness amplifier, opening and closing of which must be controlled as a function of the instant at which they take place and as a function of their duration. This control is usually carried out by means of an electrical signal which is applied between the electrodes of the tube and consequently brings the potentials of said electrodes to the operating values of said tube.

As a general rule, both the instant of opening and the instant of closure must necessarily be determined with precision. The control signal is accordingly in the form of a time-dependent square-wave signal and it is important to ensure that this latter is transmitted to the tube without any deformation. In particular, the time-widths of the leading edges of the signal must not be increased as this would have the additional disadvantage of limiting the minimum value of opening time which can be utilized.

Taking into account the speed of phenomena to be studied, the opening times must often be very short, for example of the order of a few nanoseconds or a few hundredths of a picosecond.

The opening signal then passes along a wave-propagation line, thus giving rise to the problem of matching said line with the tube.

When the end of a line of this type is connected to a photoelectric tube of conventional design which essentially comprises a photocathode and a screen within a glass envelope, matching of the line is very far from being achieved by reason of the interelectrode capacitance of the tube and by reason of the presence of the envelope glass as dielectric material.

The elegant manner of achieving perfect matching of the line with the tube is to design this latter so that its active portion itself constitutes an element of said propagation line and consequently has the same characteristic impedance. A photoelectric tube which offers such a distinctive feature has been described in an article published in the review entitled: "Advances in Electronic and Electron Physics," No 33, year 1970, pages 1131–1136, the title of the article being: "An ultrafast shutter tube with exposure time below 0.5 ns."

In this device, the conductors of the line element are constituted by the photocathode and the screen which are both flat, the dimensions and spacing of these latter being such that the characteristic impedance of said element is equal to that of the portion of line which is located outside the tube and along which the opening signal propagates.

With a device of this type, said signal undergoes very little deformation and this permits opening times of less than 300 ps.

The disadvantage of a device of this type often lies in the lack of brightness gain. This gain increases with the signal voltage applied between electrodes but a limitation is very soon imposed by the potential danger of electrical breakdown. It would also be possible to increase this gain with a constant value of electric field by increasing the spacing between electrodes but this would also increase the diameter of the image spot on the screen, thus considerably reducing the spatial resolution of the tube. In actual fact, the voltages which can be employed in practice are consequently of fairly limited value, for example of the order of 12 kV. This results in luminance gains having a maximum value of the order of 20 to 30.

Even assuming that breakdown problems can be solved, it must still be noted that the achievement of luminance gains of considerably higher value would make it necessary to employ generators for producing signals having a very high voltage such as 100 kV, for example, as well as propagation lines having very high insulating properties. All these means would prove difficult to apply in practice and would entail high capital expenditure.

The photoelectric shutter tube in accordance with the invention is not subject to the same disadvantages. By introducing a secondary-emission microduct wafer within said duct between the photocathode and the screen, it is easily possible to obtain a luminance gain of the order of 1000 in the case of opening control voltages of the order of 6 kV, for example, which can readily be keyed. The introduction of a wafer of this type within the tube makes it necessary to replace a predetermined depth of vacuum with its natural dielectric coefficient by a thickness of glass having a dielectric coefficient which is different from that of the vacuum.

It can readily be understood that the introduction of a thickness of glass into the line element of the prior art mentioned in the foregoing in which it is assumed that the conductors are still constituted by the photocathode and the screen would be a cause of mismatching of the line located outside the tube with respect to said element.

Moreover, the operation of the microduct wafer as electron multipliers usually makes it necessary to ensure that both faces of the wafer are metallized in order to apply an accelerating electric field within the interior of the ducts. Said wafer together with its two deposited metal layers would in that case behave as a secondary transmission line with respect to the line constituted by the photocathode and the screen, with a propagation velocity within the wafer which is different from that which exists within a vacuum, thus making it impossible to match said line with the line placed externally of the tube. The whole merit of the invention therefore lies in the fact that all these difficulties have been overcome.

The invention makes it clear in the first place that, in the case of operation in pulses of short duration of a few tens of nanoseconds in which the tube is released by means of a voltage signal applied between input face of wafer and screen, the potentials are naturally distributed between thickness of wafer and wafer-screen output space by virtue of the capacitive dividing bridge which makes use of the thickness of glass of wafer and depth of vacuum between wafer and screen without necessarily calling for the presence of a metal coating on the output face of the wafer. It is true that a longitudinal electric field component is found to be present in this case whilst the propagation velocity is established at an intermediate value between that which exists in the vacuum and that which exists in the dielectric. However, since said longitudinal electric field component is approximately proportional to the time derivative of the normal component it appears only at the instants which correspond to the leading and trailing edges of the signal and therefore to instants which are not troublesome, particularly as the amplitude of this component does not exceed 1 to 4% of the normal component when the leading-edge and trailing-edge pulse times are not shorter than 100 picoseconds.

As a consequence of the foregoing, the invention dispenses with the need for any metal coating on the exit face. Once this requirement has been removed and taking this remark into consideration, the basic concept of the invention consists in making use of the space between the wafer input face and the screen in order to provide a tube-opening control space. This accordingly gives it the form and function of a wave-propagation line element having characteristics which are identical with those of the propagation line located outside the tube for transmitting the control signal to the tube, said line being connected to said control element.

The conductors of the line element aforesaid consist of the metal layer deposited on the input face of the wafer and the metal layer deposited on the screen. The wafer layer is limited for example to a rectangle and the signal travels in the direction of the length of said rectangle.

In accordance with the invention, the control element aforesaid is so arranged and dimensioned as to satisfy the conditions of matching of the impedance of said element with that of the line outside the tube. The dimensions take into account the various dielectric media (glass and vacuum) which are present and the desired performances in conjunction with the operation of the electron-multiplier wafer. Said dimensions represent a compromise between the spatial resolution on the screen by employing proximity focusing on said screen, permissible and necessary division of potential between wafer face and wafer-screen space, upper limit of time-duration of the control signal which can be utilized in conjunction with the length of the wafer coating whereas the width is a function of the value of matching impedance imposed by the means employed for transferring the control signal to the tube.

There has thus been developed in accordance with the present invention a photoelectric shutter tube of the type which essentially comprises, in sequence and parallel to each other, a photocathode brought to a predetermined electric potential, a secondary-emission microduct wafer, a screen composed of a layer of material which is phosphorescent under the impact of electrons and coated on the wafer side with a so-called screen layer. A characteristic feature of the invention lies in the fact that a metal deposit or so-called wafer layer is applied only on that face of the wafer which is directed towards the photocathode, said wafer layer being brought to a potential which is equal to or higher than that of said photocathode. The space located between wafer and screen layers is so arranged as to provide a wave-propagation line element of the biplanar type in which the conductors are constituted by said layers. The characteristic impedance of said element is equal to that of a propagation line which is located externally of the tube for carrying a pulse signal and to which it is connected. The invention is further distinguished by the fact that the tube comprises electrically matched means for bringing said line element out through the tube envelope and connecting said element to the external line and that a voltage signal is applied to the line element and progressively brings the screen layer to a higher potential than that of the wafer layer.

A better understanding of the invention will be gained from the following description of several embodiments of the invention, reference being made to the accompanying drawings, in which.

Figure 1:
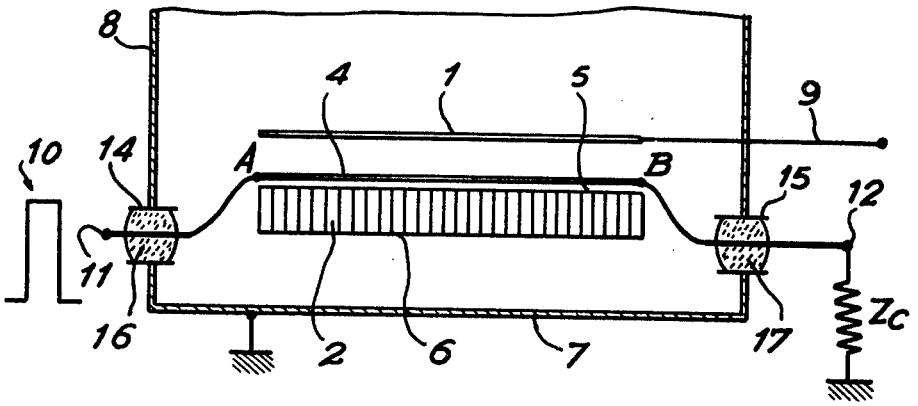
FIG. 1 is a longitudinal sectional view of the tube in accordance with a first embodiment of the invention.
Figure 2:
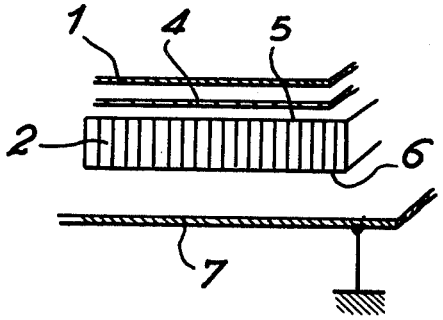
FIG. 2 is a transverse sectional view of said tube in accordance with said first embodiment.

In FIG. 1, the tube in accordance with the invention is shown in longitudinal cross-section, that is to say parallel to the direction of propagation of the opening signal. In FIG. 2, the tube is shown in cross-section at right angles to said direction of propagation.

In these figures, a photocathode is designated by the reference numeral 1, a microduct wafer providing secondary electron emission is designated by the reference numeral 2 and a metal layer deposited on the face 5 of the microduct wafer 2 is designated by the reference numeral 4. For the sake of enhanced clarity of the drawings, said layer has been shown at a substantial distance from said face. The face 6 of said wafer is not coated with a metal layer. The face 5 of said wafer which has the shape of a rectangle is shown along its length AB in FIG. 1 and along its width in FIG. 2.

A phosphorescent screen is provided opposite to the wafer with a deposited metal layer designated by the reference 7. In FIG. 1, the tube envelope which is assumed to be of metal, for example, is shown partially and designated by the reference numeral 8.

The screen is placed over a window (not shown) which is transparent to light and is electrically connected for example to the tube envelope. By way of example, this envelope will be at the reference ground potential of the complete assembly. With reference to said ground potential, the photocathode is brought to a negative potential of the order of several kilovolts by means of the insulated conductor 9 of the envelope 8.

The wafer-screen space consitutes the opening control space of the tube and is arranged in the form of wave-propagation line elements of the biplanar type, the conductors of which are constituted respectively by the wafer layer 4 and the screen layer 7.

For the purpose of opening the tube, a voltage pulse signal as shown at 10 is applied between the conductors. This signal travels from A to B, the starting-point of the wave being located opposite to the point A. This signal has an amplitude of a few kilovolts and a value such that the deposited wafer layer 4 is brought to a negative potential with respect to the screen but to a positive potential with respect to that of the photocathode. The cross-sectional area of the tube in the open condition varies progressively and at the same time as propagation of the signal wave takes place. At each instant, said cross-sectional area is equal to that of the rectangle whose width is equal to that of the rectangle of the wafer layer 4 and whose length corresponds to the distance traveled by the signal wave.

At the time of application of the signal between the screen layer 7 and the wafer layer 4 and at the time of propagation of said signal, the potential is distributed by capacitive division between wafer thickness and wafer-screen space, with the result that the wafer is capable of operating as an electron multiplier.

The dimensions of the control space aforesaid are calculated so as to ensure that the line element thus constituted has the same characteristic impedance as the portion of line located outside the tube, thereby permitting transmission of the control signal to the tube and also in order to ensure that the tube has the desired luminance gain and resolution. This accordingly involves the thickness of the wafer and the distance between wafer and screen as well as the voltages which can be employed.

FIG. 1 shows diagrammatically the method whereby the line element which is integrated with the tube is connected to the external line and similarly shows how said element is closed on its characteristic impedance. On each side of the edges of the wafer, the curved metal layer 4 and the space between metal layer and screen becomes progressively narrowed so as to take into account the fact that the thickness of glass having a dielectric coefficient which is higher than that of the vacuum has been suppressed between conductors.

Finally, the wafer layer 4 is connected to the central conductors 11 and 12 of two coaxial outputs, the external metallic portions 14 and 15 of which are welded to the tube envelope and the insulating beads of which are designated respectively by the reference numerals 16 and 17.

By means of the conductor 12, the line element which is incorporated with the tube is closed on its characteristic impedance Zc.

The operation of the tube is explained with reference to FIG. 3. This figure represents the amplitude of the tube release signal as a function of time. Said signal is the signal OACEFO' and is applied between the wafer layer 4 and the screen. The time scale *t* has been purposely enlarged in order to show the rise time of the signal represented by the segment AB. The leading edge of the signal is represented by the segment AC. By way of example and in order to gain a clear idea, the signal will have a peak amplitude of 6 kV and a rise time of 300 picoseconds. The screen layer is permeable only to high-energy electrons and is traversed only by those electrons which have undergone a high degree of acceleration within the wafer and within the wafer-screen space. Electrons of this type exist only when the signal voltage has attained a sufficiently high value at its leading edge and has been maintained beyond this value during the time required for the multiplication and acceleration to take place within the wafer and within the wafer-screen space. This time-duration is of the order of magnitude of 1 nanosecond. It will therefore be necessary to contemplate a signal peak duration which is equal to the desired duration of the exposure time increased by approximately 1 nanosecond. If this value of voltage to be obtained is 3 kV, for example (which corresponds to the point N projected at D on the time axis), the leading-edge time of initiation of opening of the tube is thus reduced by at least the time corresponding to the segment AD. The time-duration of said leading edge is represented by the segment DB which is considerably shorter than AB; in addition, said leading edge is subject to a time-delay DD' which is equal to the time required for multiplication and acceleration of the electrons, this time being estimated at approximately 1 ns. This leading edge is shown at D'C'; in this case the scale of ordinates represents the luminance gain of the tube.

Figure 3:
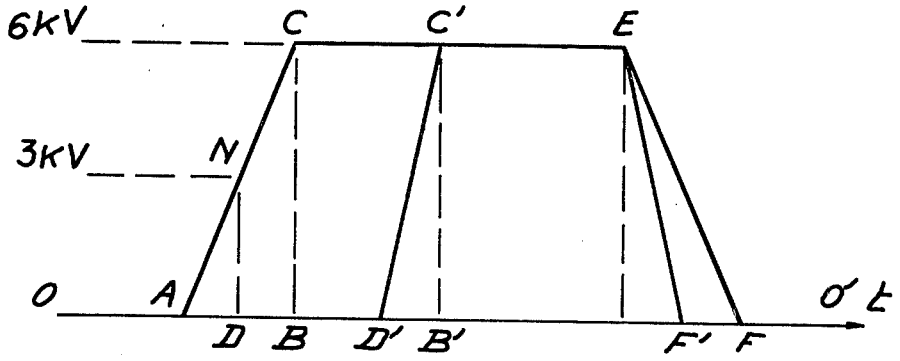
FIG. 3 is a diagram which explains the operation of said tube.

The phenomenon of closure is also subject to a similar shortening of time-duration, the closure front or trailing edge being shown at EF' in FIG. 3.

The phenomenon is actually more complicated and another fact which comes into consideration is that the wafer gain and the screen brightness vary exponentially with the voltage applied. In consequence, the reduction in time-duration of the fronts for opening and closure of the tube with respect to the signal fronts is even more marked than is apparent from FIG. 3.

The orders of magnitude of the performances obtained by means of a tube constructed in accordance with the present invention are as follows:

Area of shutter—: 10 × 25 mm

Exposure time—: 300 ps to 10 ns

Spatial resolution: higher than or equal to 10 pairs of lines per millimeter

Closure ratio—: higher than or equal to $10^5$ (ratio between light transmitted in the presence and in the absence of a voltage signal).

It is readily apparent that the tube in accordance with the present invention can be extended to alternative forms of construction as a function of the region of the electromagnetic spectrum observed. In particular, in one alternative form which is well suited to the detection of X-radiation, the photocathode is in fact an X-photon/electron converter constituted by a metal deposit of gold or nickel for example on a thin sheet of beryllium which is applied against the input wafer face and is in direct contact with the metal layer of said wafer. The integrated wave-propagation line within the tube is provided with a conductor which consists of said beryllium layer, in which case the tube control space contains all the active elements of the tube, the control signal being applied between the beryllium sheet and the screen.

Figure 4:
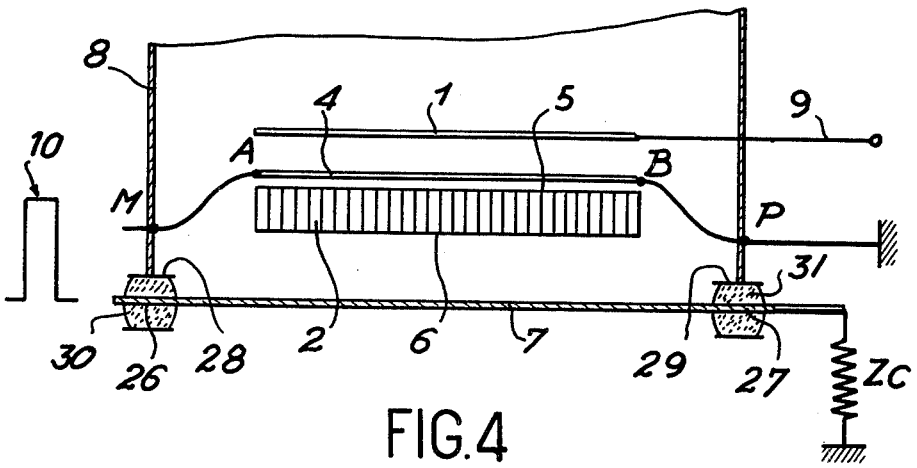
FIG. 4 is a longitudinal sectional view of the tube in accordance with a second embodiment of the invention.

It is further apparent that alternative forms of the present invention can be contemplated in regard to the mode of polarization of the different electrodes with respect to each other and the mode adopted for applying the opening signal. One of these variants is shown in longitudinal cross-section in FIG. 4. In this figure, the different elements are designated by the same reference numerals as in FIG. 1. In this alternative form, the wafer layer 4 is brought to a reference potential, namely the potential of the envelope 8 which is assumed to be a metal envelope. Said wafer layer is connected to the envelope at the points M and P. On the other hand, the screen layer 7 is insulated from said envelope and connected to the central conductors 26 and 27 of two matched coaxial outputs, the metallic portions 28 and 29 of which are welded to the tube envelope 8 and the insulating beads of which are designated respectively by the reference numerals 30 and 31. The photocathode is brought to a potential which is either lower than or equal to the reference potential by means of the conductor 9 which is insulated from the envelope. The signal 10 which is applied between wafer layer and screen layer brings the surface of the screen layer progressively to a positive potential with respect to the reference potential at the time of application of said signal.

In the embodiments described in the foregoing, the wafer layer has a rectangular shape. It is readily apparent that the invention also includes within its scope alternative forms of construction in which this deposited metal layer could be given any other shape such as for example, a snaked-coil or Greek-key pattern.

I claim:

1. A photoelectric shutter tube of the type which essentially comprises in sequence and parallel to each other a photocathode brought to a predetermined electric potential, a secondary-emission microduct wafer, a screen composed of a layer of material which is phosphorescent under the impact of electrons and coated on the wafer side with a so-called screen layer, wherein a metal deposit or so-called wafer layer is applied only on that face of the wafer which is directed towards the photocathode, said wafer layer being brought to a potential which is equal to or higher than that of said photocathode, the space located between wafer and screen layers being so arranged as to provide a wave-propagation line element of the biplanar type in which the conductors are constituted by said layers, the characteristic impedance of said element being equal to that of a propagation line which is located externally of the tube for carrying a pulse signal and to which it is connected, wherein the tube comprises electrically matched means for bringing said line element out through the tube envelope and connecting said element to the external line and wherein a voltage signal is applied to the line element and progressively brings the screen layer to a higher potential than that of the wafer layer.

2. A photoelectric tube according to claim 1, wherein the wafer layer has the shape of a rectangle and propagation takes place parallel to the length of said rectangle.

3. A photoelectric tube according to claim 1, wherein the photocathode is a converter for converting X-photons to electrons or ultraviolet photons to electrons, said converter being constituted by the wafer layer itself.

4. A photoelectric tube according to claim 1, wherein the photocathode is a X-photon/electron converter constituted by a very thin layer of a suitable metal selected from the group consisting of gold, tantalum, and nickel which is deposited on a beryllium sheet.

5. A photoelectric tube according to claim 4, wherein the converter is in contact with the wafer layer.

6. A photoelectric tube of a type similar to the tube according to claim 1 and comprising the same elements, the space between the wafer and screen layers being so arranged as to form a wave propagation line element, wherein the screen layer is brought to a higher reference potential than that of the photocathode and wherein a voltage signal applied to said line element brings the wafer-layer potential to a negative potential with respect to the screen-layer potential.

7. A photoelectric tube according to claim 6, wherein said screen reference potential is that of the metal envelope of the tube.

* * * * *